US006073622A

United States Patent [19]

Steimer

[11] Patent Number: 6,073,622

[45] Date of Patent: Jun. 13, 2000

[54] COOLANT OPERATED SEALANT HEATER

[76] Inventor: David Norman Steimer, 9327 Inver Grove trail, Inver Grove Hts., Minn. 55076

[21] Appl. No.: 09/036,642

[22] Filed: Mar. 6, 1998

Related U.S. Application Data

[60] Provisional application No. 60/040,173, Mar. 11, 1997.

[51] Int. Cl.[7] ..... F01P 11/00

[52] U.S. Cl. ..... 126/19.5; 126/284

[58] Field of Search ..... 126/19.5, 284, 126/343.5 A; 165/80.1, 80.5, 300; 236/93 A

[56] References Cited

U.S. PATENT DOCUMENTS

| | | | |
|---|---|---|---|
| 1,013,336 | 1/1912 | Tyden | 126/284 |
| 1,213,772 | 1/1917 | McCoen | 126/19.5 |
| 2,339,087 | 1/1944 | Mantz | 126/19.5 |
| 2,682,264 | 6/1954 | Garrett | 126/19.5 |
| 5,787,876 | 8/1998 | Schultz | 126/284 |

FOREIGN PATENT DOCUMENTS

| | | |
|---|---|---|
| 9220491 | 1/1993 | Australia . |

*Primary Examiner*—Ira S. Lazarus
*Assistant Examiner*—Sara Clarke
*Attorney, Agent, or Firm*—David N. Steimer

[57] ABSTRACT

An apparatus, method, and system for heating adhesive sealant to operating temperature by means of a heat transfer from a source of hot liquid.

11 Claims, 7 Drawing Sheets

COOLANT OPERATED SEALANT HEATER

CROSS REFERENCE TO RELATED APPLICATIONS

This utility application filed under 35 U.S.C. § 119(e) (1), of claims the benefit provisional application Serial No. 60/040,173 previously filed Mar. 11, 1997.

BACKGROUND OF THE INVENTION

1. Field of the Invention

The present invention generally relates to techniques for curing adhesives and more particularly relates to techniques for curing heat catalyzed adhesives.

2. Description of the Prior Art

There is a type of urethane adhesive widely used in the replacement auto glass industry which must be heated to at least 180° F. prior to application in order to catalyze its curing process and improve its ability to be applied by means of a caulking gun. The only heater currently available for this purpose which may be installed in a vehicle for mobile auto glass replacement is operated from the service vehicle's 12 VDC electrical system.

Urethane adhesive is used to form a structural bond of the windshield and back lite to the vehicle. There are two major types of urethane adhesives which cure using different chemical reactions. Each type has its advantages and disadvantages. One type is a two part system in which the parts must be mixed prior to application. The second type uses temperature and humidity as its catalyst. A predominant supplier of the second type is Sika Industries. The Sika UltraFast® and SikaPlus Booster® urethane adhesives must be heated to 180° Fahrenheit (F.) prior to application.

Auto glass replacement is a service industry in which mobile operation in the norm, I.e. the preponderance of all replacement is done at a location of the customer's choosing. This means that the installation must be accomplished out of a service vehicle. Sika manufactures a sealant heater for use in service vehicles. It is powered from the vehicle's 12 VDC electrical system, consumes about 150 Watts of power, and allows two tubes of sealant to be heated. Many windshields and back lites require more than one tube of adhesive and some require more than two. Further, the time between successive mobile installations is frequently under 30 minutes. The electrical sealant heaters do not provide sufficient heated sealant for some installations and the time required to heat additional tubes of sealant frequently exceeds the available interval between jobs.

SUMMARY OF THE INVENTION

The present invention overcomes the disadvantages of the prior art by utilizing engine coolant from a vehicle as the heat source for warming adhesive. In addition, it solves both the capacity and heating time problems which characterize the prior art.

The Coolant Operated Sealant Heater (COSH) consists of a closed metal reservoir with an inlet and an outlet to allow the admission and exit of engine coolant. A set of open ended heating tubes pass completely through the reservoir. The outlet contains a thermostat which limits the operating temperature of the COSH to 190° F. The heating tubes are located within the reservoir so as to force the heating fluid to flow around all heating tubes causing all of them to be heated equally. The COSH is designed with the heating tubes elevated above the mounting feet such that when adhesive cartridges are placed in the chambers, the plunger end of the cartridge projects outside the heater and is not directly warmed. This prevents plastic plungers from being softened thereby allowing adhesive to escape out the back of the cartridge. It also prevents spilled sealant from accumulating at the bottom of the tube eventually blocking sealant tubes from being inserted into the heater. The COSH is connected by hoses to the service vehicle engine's cooling system in the same manner as the vehicle's heater core. The engine coolant pump circulates coolant through the COSH. The sealant heater is in full operation anytime the engine is running at normal operating temperature. The device accommodates one tube of sealant in each heating chamber and is designed such that the tubes are loaded into the heater with the plunger end down/nozzle end up. This device requires no maintenance or adjustments and utilizes waste engine heat rejected into the coolant. It places no additional load on the vehicle's drive train or electrical system. Because of the large thermal mass of metal and coolant in the heater, it retains heat for a significantly longer time than the electric heater after the vehicle is shut off. This reduces the time the engine must be kept operating simply to keep the sealant hot.

BRIEF DESCRIPTION OF THE DRAWINGS

Other objects of the present invention and many of the attendant advantages of the present invention will be readily understood by reference to the following detailed description when considered in connection with the accompanying drawings, in which like reference numerals designate like parts throughout the figures thereof and wherein.

DETAILED DESCRIPTION OF THE INVENTION

Figure 1:
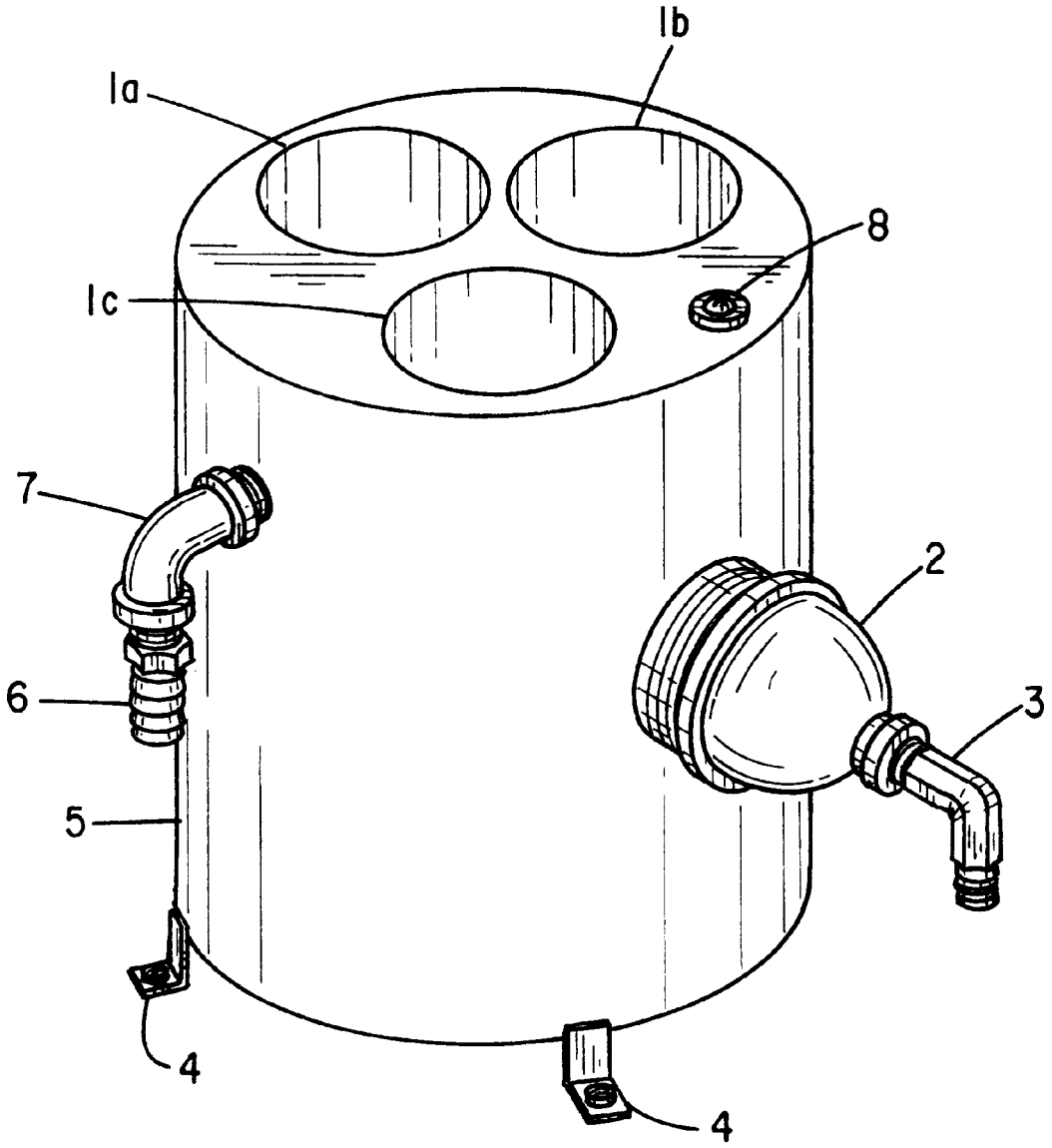
FIG. 1 illustrates a perspective view of the COSH of this application.
Figure 2:
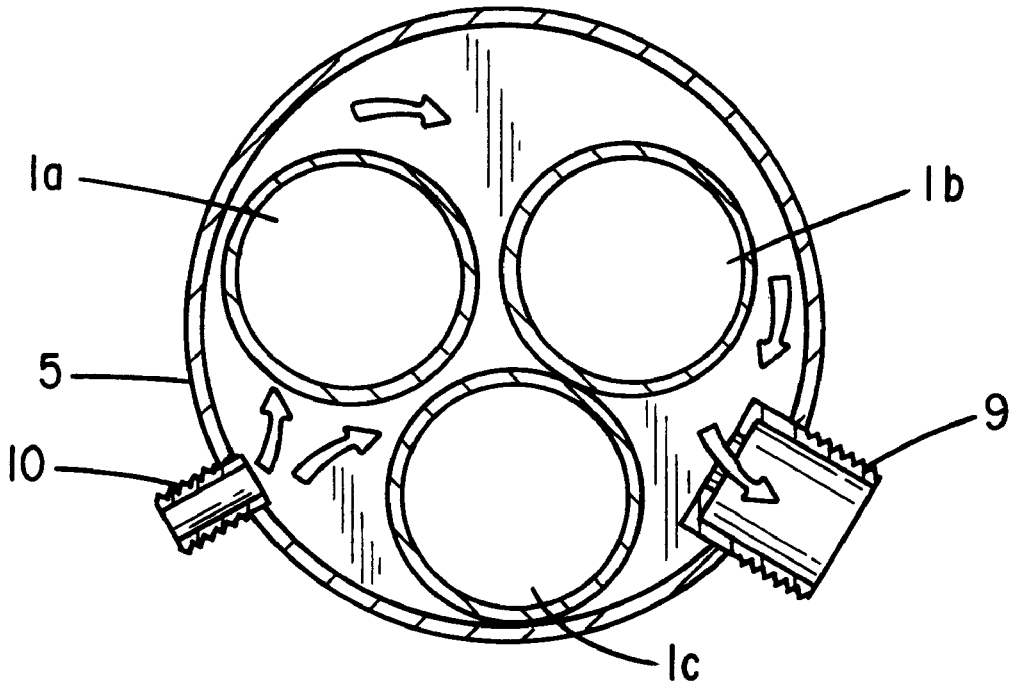
FIG. 2 illustrates the forced coolant flow around all heating chambers of the COSH resulting from their particular placement as shown in FIG. 5.
Figure 5:
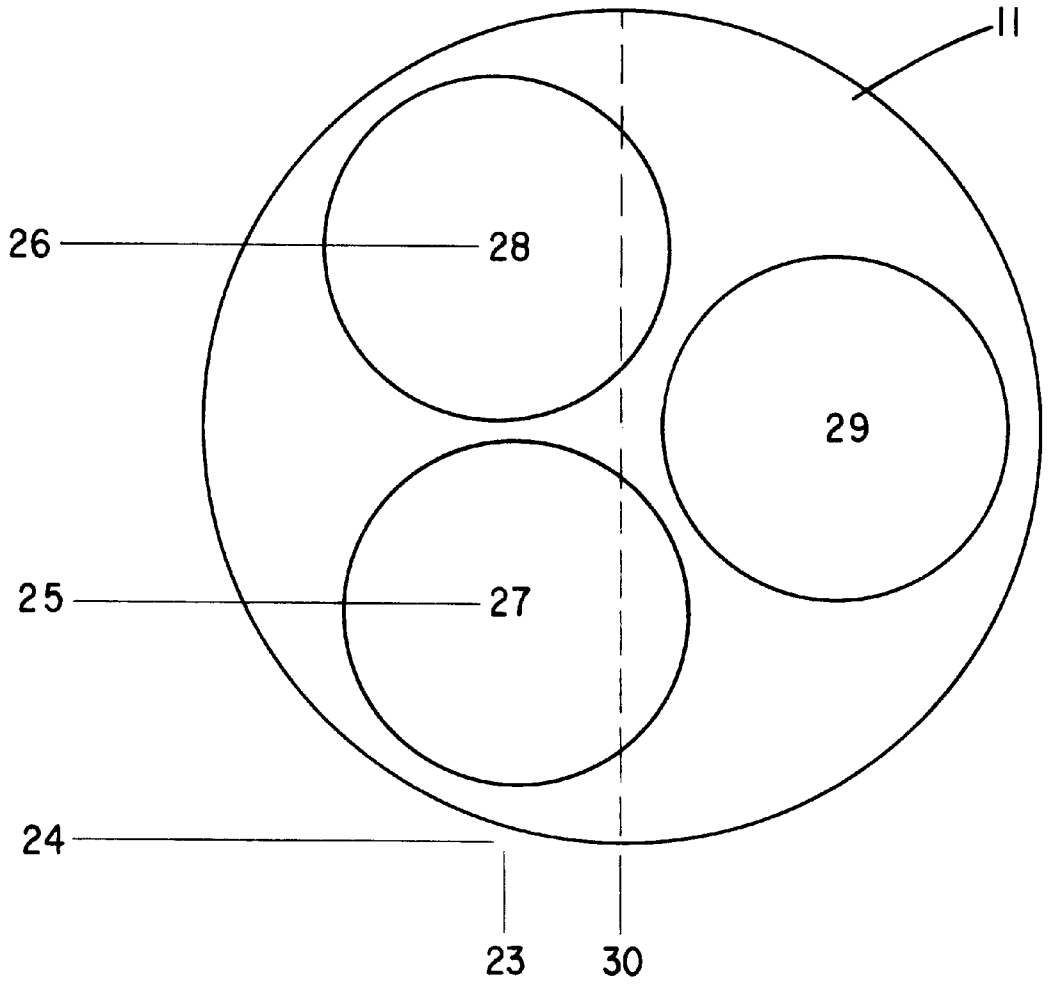
FIG. 5 illustrates the end cap of the COSH showing the exact location of the heating chambers within the COSH body so as to effect the coolant flow depicted in FIG. 2.

The COSH device described in this section is shown in perspective view as a completed unit in FIG. 1. The COSH is designed to ensure that coolant will circulate around all of the heater tubes. With reference to FIG. 2, this is accomplished by placing heater tubes (1*b* & 1*c*) off center and in physical contact with each other and one side of the housing such that the direct coolant path from inlet (10) to outlet (9) is blocked. This forces the coolant to flow around tube (1*a*) before flowing around to the back side of tubes (1*b* & 1*c*)

and the outlet. The arrows in FIG. 2 show coolant flow through the heater. FIG. 5 shows the exact end plate configuration to position the heater tubes within the housing. With reference to FIG. 5, the outside diameter of the end plate (11) is 5.75". The three holes (27, 28, & 29) in the end plate (11) each have the same diameter of 2.38". The dashed reference line (30) represents a centerline of the endplate. The solid reference line (24) is tangent to the endplate (11) at the intersection point of the centerline (30). The solid reference line (23) is parallel to the centerline (30) and the distance between these two lines is 0.7866". The solid reference line (25) is parallel to reference line (24) and the distance between these two lines is 1.5978". The solid reference line (26) is parallel to reference line (25) and the distance between these two lines is 2.38". The center of the hole (27) is at the intersection of reference lines (23) and (25). The center of hole (28) is at the intersection of reference lines (23) and (26). The center of hole (29) is located at a distance of 2.50" from the center of hole (27) and from the center of hole (28). When assembled, heater tube **(1*c*) is placed through hole (27), heater tube (1*b*) is placed through hole (28), and heater tube (1*a*) is placed through hole (29)**.

Figure 3:
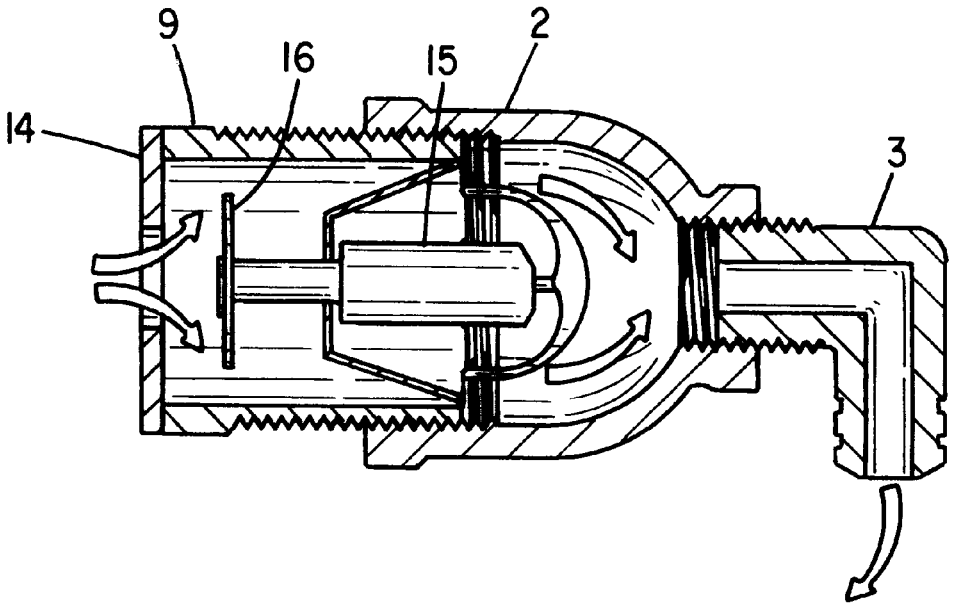
FIG. 3 illustrates the mounting of the thermostat so as to limit the operating temperature of the COSH.

The COSH incorporates a thermostat as shown in FIG. 3 which is designed to limit the temperature of the sealant heater to 190° F. This is necessary because most engines are equipped with thermostats that force the engine to operate at or above that temperature. The COSH thermostat is placed in the coolant outlet path so that it more accurately detects the temperature at which the heater is operating rather than the entering temperature of the coolant.

The COSH heater tubes are completely open at both the top and bottom ends and the entire heater is supported on legs approximately ⅞ inch off the surface to which it is mounted. The primary reason for this design is so that the plastic plunger located at the bottom of the sealant tube, which forces sealant from the tube when placed into the caulking gun, will not be directly heated thereby becoming soft and allowing sealant to escape around the back of the tube. The secondary reason for this design is that it does not allow spilled sealant to accumulate at the bottom of the tube eventually blocking sealant tubes from being inserted into the heater.

Figure 6:
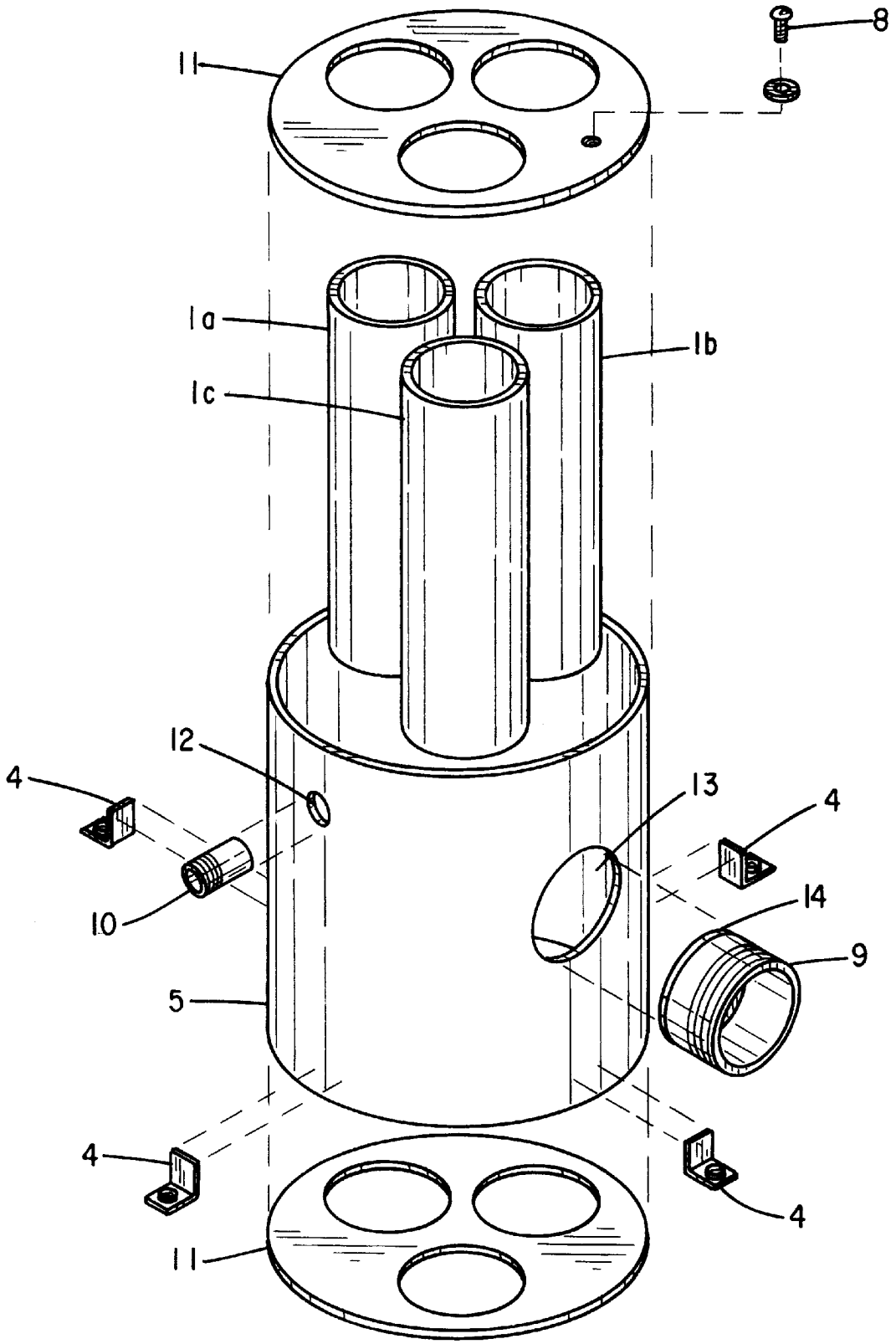
FIG. 6 illustrates an exploded view of all welded components which form the COSH body.

The sealant heater is constructed out of welded steel. With reference to FIG. 6, the body consists of a housing of 5.75" outside diameter (OD) tubing (5), three pieces of 2" pipe which serve as the heating tubes for the sealant **(1*a*, 1*b*, & 1*c*), and two end plates (11). The inlet (10) and outlet (9) are welded into holes in the side of the body and the outlet accommodates a thermostat for controlling the temperature of the heater. The sections of 2" pipe pass completely through the heater body and the entire body is supported approximately ⅞" above the mounting surface by four steel legs (4). With reference to FIG. 3, the thermostat (15) is housed in the outlet (9) and retained by a reducing bushing (2) and spring. A 1.75" OD by 0.625" inside diameter (ID) (14) washer is welded to the end of the outlet fitting that is inserted into the heater body. This washer serves as the seat against which the thermostat plunger (16) closes to restrict coolant flow when the upper temperature limit is reached. The length of the outlet fitting determines the upper temperature limit at which the heater operates. It is specified to allow 0.25" of travel for the thermostat plunger which establishes the upper temperature limit at between 185° and 195° F. The arrows in FIG. 3** show the coolant flow through the thermostat assembly.

Figure 4:
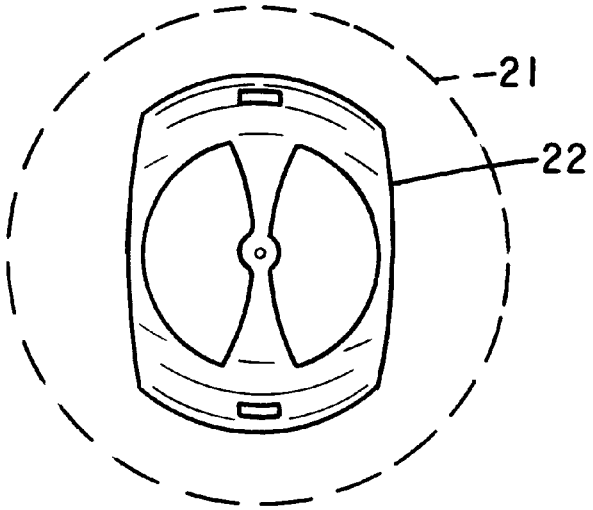
FIG. 4 illustrates the modification to the thermostat flange so as to allow passage of fluid when the COSH is below operating temperature.

With reference to FIG. 4, the thermostat mounting flange is cut away from its original circular diameter (21) of approximately 48 mm to an irregular shape (22) approximately 1.75 inches by 1.125 inches. This allows coolant to flow around the flange and prohibits the thermostat from blocking coolant flow when the heater is below the desired operating temperature.

The heater is connected to the engine using industry standard ⅝ inch ID heater hose. The existing heater supply and return hoses are located and a "Y" connection is inserted in each at a location that is not affected by any flow restricting valves used to control vehicle interior temperature. This allows full coolant flow to the sealant heater at all times regardless of the setting of the vehicle heater temperature control. The supply hose is connected to the inlet fitting located near the top of the heater and the return hose is connected to the outlet fitting located at the end of the sealant heater thermostat housing. The supply hose should be insulated if it runs any significant length or is routed outside of the vehicle body. A bleeder screw (FIG. 1, #8) is provided at the top of the COSH to remove any trapped air from the system after installation.

The following paragraphs detail the design, materials, and construction of the COSH. All dimensions are in inches unless specified otherwise.

Materials List

| Ref. No. | Description |
|---|---|
| 5 | 1 pieces (pc.) - mild steel tubing 5.75 inches (") OD × 5.5" ID × 7.25" Long. |
| 1a,1b,1c | 3 pc. - 2" trade size black iron pipe, 7.625" Long. |
| 11 | 2 pc. - 10 Ga. mild steel end caps per FIG. 5 |
| 10 | 1 pc. - ⅜" trade size black iron pipe, threaded one end, 0.875" Long. |
| 7 | 1 pc. - ⅜" trade size black iron pipe elbow. |
| 9 | 1 pc. - 1.5" trade size black iron pipe, threaded one end, 1.55" Long. |
| 14 | 1 pc. - 1.75" OD × 0.625" ID unplated steel washer. |
| 15 | 1 pc. - 180° F. Thermostat to fit 1996–1992 Ford 4.6L engine (Stant #35398, Stant #35758, or equivalent) and modified as shown in FIG. 4. |
| | 1 pc. - Compression spring 1.2" ID × 1.625" Long with compression rate greater than 5 lb. per inch. |
| 2 | 1 pc. - 1.5" × ½" trade size black iron reducing coupling. |
| 3 | 1 pc. - 90°, ½" male pipe thread × ⅝" ID hose adapter barb. |
| 6 | 1 pc. - Straight, ⅜" male pipe thread × ⅝" ID hose adapter barb. |
| 4 | 4 pc. - 90° unplated steel 1" angle iron, 0.5" long |
| 8 | 1 pc. - #10x32 flat head machine screw w/ nylon washer. |

Where appropriate, cut material to length as indicated on parts list. With reference to FIG. 6 perform the following operations on the parts to prepare them for assembly:

Heater Body—Identify one end of the 5.75" OD tubing as the top and mark the following two locations on the periphery of the tube:

1. The first location (12) is 1" below the top, anywhere on the circumference.
2. The second location (13) is 3.25" below the top and 6" from the first location, measured along the circumference of the tube and counterclockwise, as viewed from the top.

At the first location (12), bore a hole 0.625" in diameter and at the second location (13), bore a hole 1.875" in diameter.

Outlet & thermostat—Remove any ridge from the inside of the threaded end of the 1.55" piece of 1.5" pipe that serves as the outlet (9) so that thermostat body will just fit inside of it with the flange resting on the threaded end. Weld the 1.75" OD washer (14) on the cut end of the pipe (9) to complete work on the outlet. Cut the flange off the thermostat as shown in FIG. 4. Place the thermostat in the outlet fitting and check to be sure that no part of the flange extends beyond the thread and that there is sufficient gap along side the narrow dimension of the thermostat to allow coolant to flow between it and the pipe.

Heater Body Assembly—With reference to FIG. 2, orient the two end plates (11) so that they both have the same side facing up and are oriented as shown. With reference to FIG. 6, place one of the plates (11) on a flat surface and stand the 3 pieces of 2" pipe (1*a*, 1*b*, 1*c*) in the holes. Place the outer tubing (5) over the pipes and position it on the bottom end plate so that the 0.625" inlet hole is positioned between the two pieces of pipe placed into end plate holes (1*a* & 1*c*) as shown in FIG. 2. Place the top plate on the assembly and be sure that pipe (1*c*) is held tightly against the inner wall of the outer tubing (5). All seams should be flush. Clamp the assembly and weld all seams.

Inlet and Outlet—With reference to FIG. 6, place the cut end of the ⅜×0.785" long pipe (10) squarely into the ⅝" inlet hole in the side of the heater body and weld it. Place the end of the outlet (9) with the washer (14) welded to it squarely into the 1.875" outlet hole in the side of the heater body and weld it. With reference to FIG. 1, tighten the ⅜" elbow (7) on to the inlet fitting and the straight hose barb fitting (6) into that. With reference to FIG. 3, place the thermostat (15) into the outlet housing (9) with the plunger end toward the heater and place the spring over the top of the thermostat. Tighten the reducing coupling (2) on the thermostat housing and then tighten the 90° hose barb fitting (3) into the coupling. Both the inlet and outlet fittings should point straight down to the bottom of the heater.

Bleeder screw—With reference to FIG. 6, drill and tap a hole for a 10-32 screw in the heater top plate above the inlet fitting. With a file, dress the top plate around the tapped hole to be sure there is no ridge around the hole. Grind a flat spot along one side of the bleeder screw (8). The flat should be below the thread root and at least 3/16" long. The flatted area should start at least 3/16" from the bottom of the nylon washer under the screw head. Install and tighten the bleeder screw in the heater body. Plug the outlet passage and pressure test the heater to at least 25 p.s.i.

Legs—With reference to FIG. 1, support the heater body (5) ⅞" above a flat surface and weld the four angle iron legs (4) to the base of the heater body such that they will support the body at that distance off the mounting surface. The position of the legs is not critical so long as they do not interfere with the inlet and outlet and are sufficiently spaced to provide a stable mounting.

Finishing—With a grinder, round off all edges then perform a final pressure test on the assembly. Clean and paint the heater.

Windshield and Back Lite Replacement Process

This section describes the typical process of replacing an automotive windshield, back lite, or other fixed, surface mount vehicle glass using heated, urethane adhesive. Upon completion of the preceding installation, adhesive for the next replacement is loaded into the sealant heater to be warmed up to its application temperature.

Glass Removal

The glass trim molding is removed from the vehicle in a manner commensurate with its mounting, I.e. mechanical or adhesive. If necessary, accessory items such as windshield wipers, visors, or mirrors are removed. If the glass has any electrical connections such as integral antennas or heaters, they are disconnected. Next, the damaged glass is cut out of its sealant bed using a powered knife or a cold knife with draw cable.

Surface Preparation

Once the old glass has been removed, the bonding surface must be prepared for the new installation. There are many options depending upon how the previous glass was mounted. Most commonly, where the previous glass was bonded with urethane adhesive, the remaining adhesive is flush cut down to a thin remaining layer so that the new adhesive can bond to the existing urethane. In other cases where a different adhesive was used or the mounting pinch weld has become rusty, all of the old adhesive must be removed and the metal sanded to remove any rust. If any of the mounting pinch weld has been exposed to bare metal, a primer is applied to it prior to the application of new sealant. Finally, a cleaner is used on the perimeter of the new glass to assure a good bond to the urethane adhesive.

New Glass Installation

A tube of sealant is removed from the heater and placed into the caulking gun, frequently a power operated device, and a cold tube of sealant is placed into the empty heater opening to warm for the next installation. Depending upon the vehicle, the new urethane adhesive is applied either to the new glass or to the mounting pinch weld. Once applied, there is a very short period during which the glass may be installed in the vehicle and positioned properly. The heavy body of the adhesive holds the windshield in place during the curing process. On vehicles where the glass trim is separate, it is applied next either mechanically or with adhesive, as required. Any required electrical connections are made and the rear view mirror is typically mounted to a windshield. Finally, any remaining accessories are remounted.

Alternate Embodiment

Figure 7:
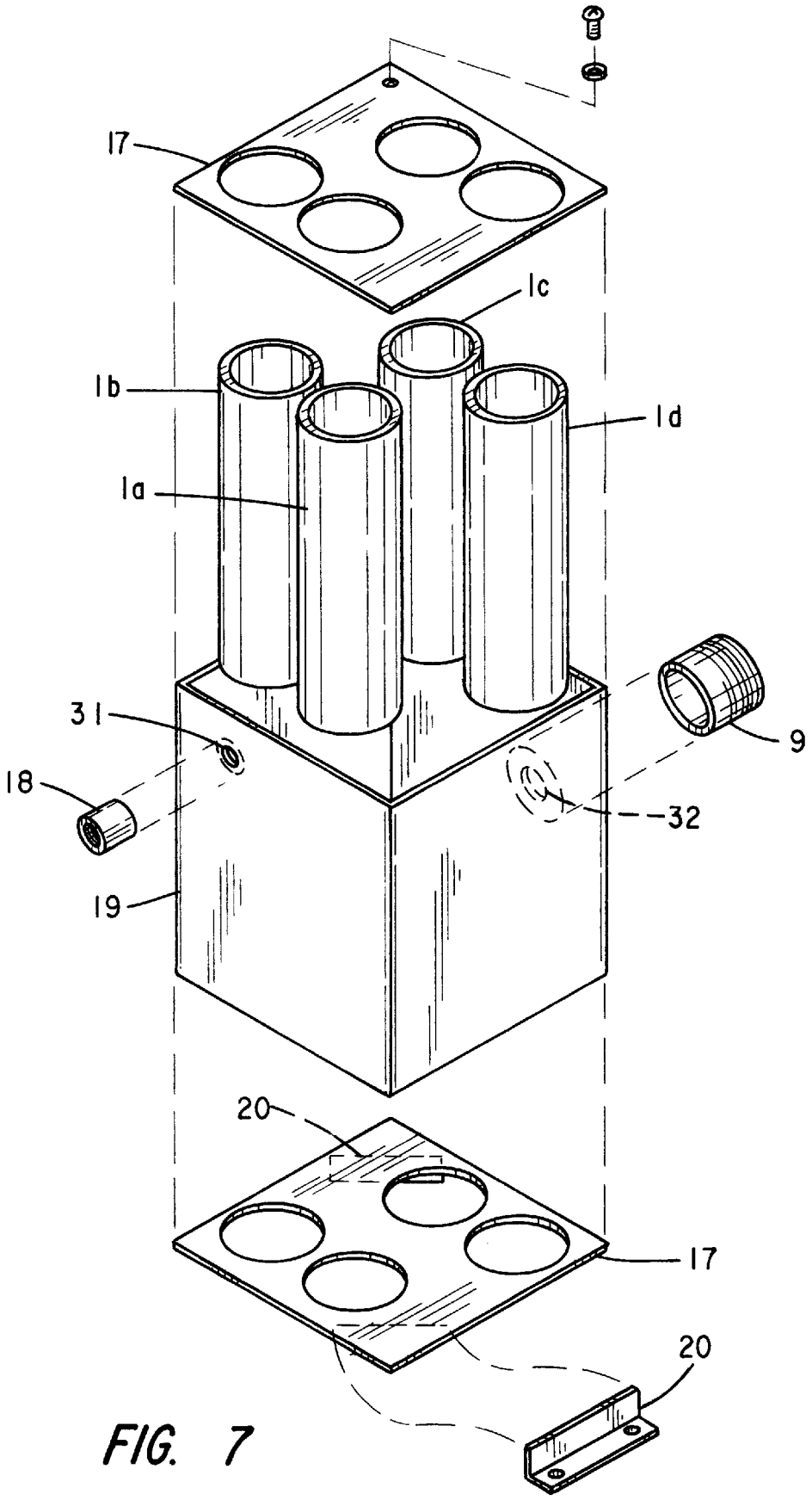
FIG. 7 illustrates an alternate embodiment of the COSH with four heating chambers.

FIG. 7 shows an alternate embodiment of the Coolant Operated Sealant Heater. This embodiment differs from the original in that it accommodates four sealant tubes instead of three. All other features and design criteria remain unchanged.

Figure 9:
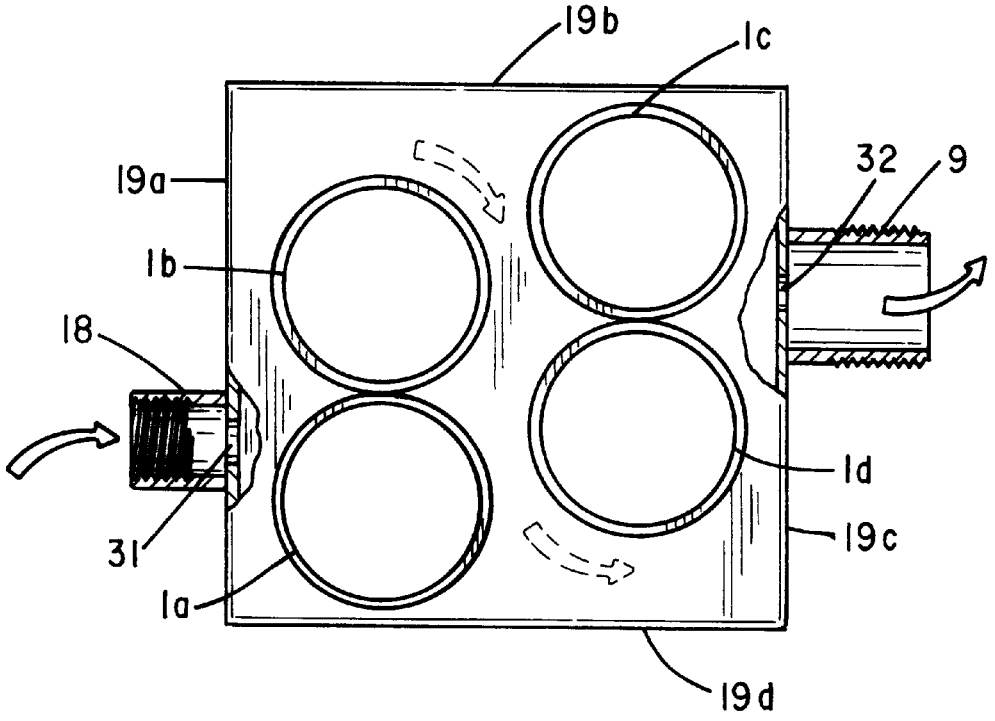
FIG. 9 illustrates the forced coolant flow around all heating chambers of the COSH alternate embodiment resulting from their particular placement as shown in FIG. 8.

FIG. 9 shows the placement of heater tubes within the heater body and the arrows indicate the controlled coolant flow resulting from that placement. With reference to FIG. 9, heater tubes (1*a* & 1*b*) are placed in contact with each other and with the inside wall of the heater body adjacent and closest to the inlet (19*d*). Heater tubes (1*c* & 1*d*) are placed in contact with each other and with the inside wall of the heater body adjacent and closest to the outlet (19*b*). This forces coolant entering from the inlet to flow around all heater tubes in order to reach the outlet.

Figure 8:
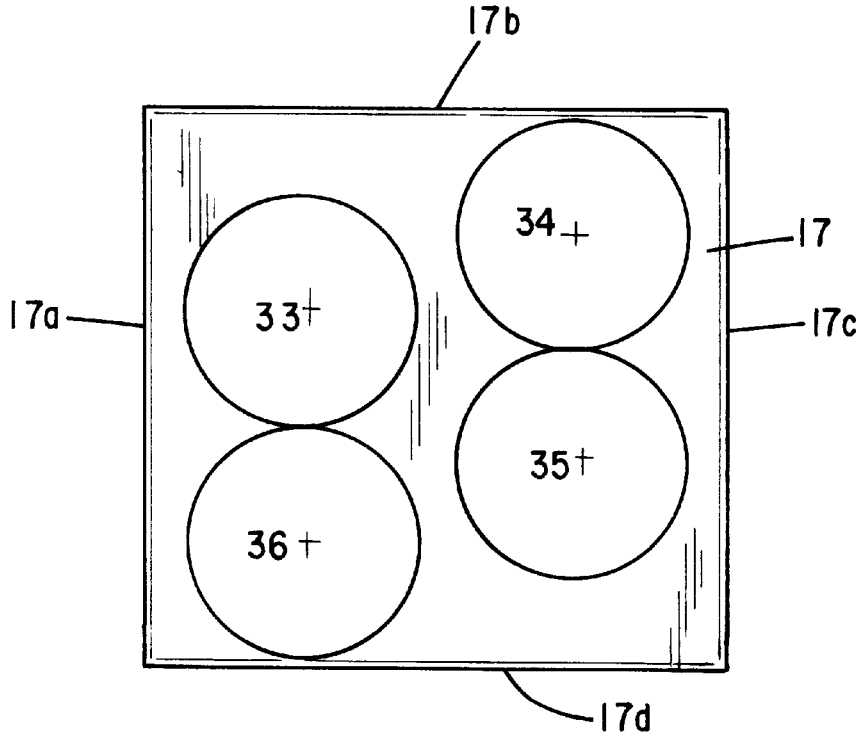
FIG. 8 illustrates the end cap of the COSH alternate embodiment showing the exact location of the heating chambers within the COSH body so as to effect the coolant flow depicted in FIG. 9.

FIG. 8 shows the dimensions of the end plates for this embodiment to produce the controlled coolant flow depicted in FIG. 9. With reference to FIG. 8, the end cap (17) is a 6" square of 10 gauge (Ga.) cold rolled steel with corners rounded to the same radius as the corners of the square tubing (FIG. 7, #19) which forms the heater body. All four holes cut in the end cap are 2.38" in diameter. The center of hole 33 is located 1.62" from end cap edge (17*a*) and 3.76" from end cap edge (17*d*). The center of hole 34 is located 1.62" from end cap edge (17*c*) and 1.38" from end cap edge (17*b*). The center of hole 35 is located 1.62" from end cap edge (17*c*) and 3.76" from end cap edge (17*b*). The center of hole 36 is located 1.62" from end cap edge (17*a*) and 1.38" from end cap edge (17*d*). When assembled, heater tube (1*a*) is placed through hole (36), heater tube (1*b*) is placed through hole (33), heater tube (1*c*) is placed through hole (34), and heater tube (1*d*) is placed through hole (35).

Materials List - Alternate Embodiment

| Ref No. | Description |
|---|---|
| 19 | 1 pieces (pc.) - 6.0" square steel tubing × 0.188" wall thickness × 7.25" Long. |
| 1a,1b,1c,1d | 4 pc. - 2" trade size black iron pipe, 7.625" Long. |
| 17 | 2 pc. - 10 Ga. mild steel end caps per FIG. 8 |
| 18 | 1 pc. - ½" trade size black iron pipe half coupling. |
| 9 | 1 pc. - 1.5" trade size black iron pipe, threaded one end, 1.55" Long. |
| 15 | 1 pc. - 180° F. Thermostat to fit 1996–1992 Ford 4.6L engine (Stant #35398, Stant #35758, or equivalent) and modified as shown in FIG. 4. |
| | 1 pc. - Compression spring 1.2" ID × 1.625" Long with compression rate greater than 5 lb. per inch. |
| 2 | 1 pc. - 1.5" × ½" trade size black iron reducing coupling. |
| 3 | 2 pc. - 90°, ½" male pipe thread × ⅝" ID hose adapter barb for both inlet and outlet. |
| 20 | 2 pc. - 90° unplated steel 0.75" angle iron, 3" long |
| 8 | 1 pc. - #10x32 flat head machine screw w/ nylon washer. |

I claim:

1. A method of warming auto glass adhesive tubes comprising:

a. placing said auto glass adhesive tubes into a heat exchanger; and b. circulating a heated fluid through said heat exchanger wherein said circulating step further comprises regulating flow of said heated fluid to heat said heat exchanger by restricting flow of said heated fluid above a predetermined temperature.

2. A method according to claim 1 wherein said circulating a flow of engine coolant through said heat exchanger.

3. A method according to claim 2 wherein said placing step further comprises placing said adhesive within said heat exchanger to facilitate even warming.

4. A method according to claim 2 further comprising improving heat regulation within said heat exchanger by permitting said heat exchanger to freely dissipate heat.

5. A combination comprising:

a. an adhesive;

b. first means for coupling a flow of automotive engine coolant;

c. a heat exchanger coupled to said first coupling means and removably containing said adhesive for transferring heat from said flow of automotive engine coolant to said adhesive wherein said heat exchanger further comprises a thermostat which regulates said flow of automotive coolant; and d. second means coupled to said heat exchanger for coupling said flow of automotive engine coolant from said heat exchanger.

6. A combination according to claim 5 wherein said adhesive is arranged within said heat exchanger to promote even heating.

7. A combination according to claim 6 wherein said heat exchanger has a cylindrical shape.

8. A combination according to claim 6 wherein said heat exchanger has a rectilinear shape.

9. A combination according to claim 6 wherein said heat exchanger further comprises an open ended tube containing said adhesive.

10. A system for heating glue tubes comprising:

a service vehicle comprising a cooling system, the cooling system containing coolant fluid;

a reservoir, defining an interior chamber, to receive heated coolant fluid from a cooling system of the service vehicle, the reservoir further comprising an inlet to receive coolant fluid and an outlet to expel coolant fluid and a thermostat to regulate flow from said inlet to said outlet;

a filling conduit having a first and second end, where the first end is connected to the inlet of the reservoir and the second end is connected to the cooling system of the service vehicle, the filling conduit allowing heated coolant fluid to flow from the cooling system to the reservoir past the plurality of glue tube chambers; and a draining conduit having a first and second end, where the first end is connected to the outlet of the reservoir and the second end is connected to the cooling system of the service vehicle, the draining conduit allowing the coolant fluid to flow from the reservoir to the cooling system.

11. A method for heating glue tubes to be used with a service vehicle, comprising the steps of:

providing a reservoir, defining an interior chamber, to receive heated coolant fluid from a cooling system of the service vehicle, the reservoir further comprising an inlet to receive coolant fluid and an outlet to expel coolant fluid;

providing a plurality of glue tube chambers, positioned within the reservoir;

connecting a first end of a filling conduit to the inlet and a second end of the filling conduit to a cooling system of the service vehicle;

allowing the heated coolant from the cooling system to flow through the filling conduit into the reservoir, fill the reservoir, and flow through the draining conduit to the cooling system;

regulating temperature of said plurality of glue tube chambers within a desired range; and inserting one or more of the glue tubes into a corresponding number of the glue tube chambers.

* * * * *